US011766084B2

(12) United States Patent
Lowe et al.

(10) Patent No.: US 11,766,084 B2
(45) Date of Patent: Sep. 26, 2023

(54) ADJUSTABLE CHIN CUP

(71) Applicant: Zam Helmets Inc., Redwood City, CA (US)

(72) Inventors: Michael Lowe, Santa Cruz, CA (US); Whitman Kwok, Emerald Hills, CA (US)

(73) Assignee: ZAM Helmets Inc., Redwood City, CA (US)

( * ) Notice: Subject to any disclaimer, the term of this patent is extended or adjusted under 35 U.S.C. 154(b) by 147 days.

(21) Appl. No.: 17/540,133

(22) Filed: Dec. 1, 2021

(65) Prior Publication Data

US 2022/0183416 A1 Jun. 16, 2022

Related U.S. Application Data

(60) Provisional application No. 63/124,974, filed on Dec. 14, 2020.

(51) Int. Cl.
*A42B 3/08* (2006.01)

(52) U.S. Cl.
CPC ..... *A42B 3/08* (2013.01)

(58) Field of Classification Search
CPC ..... A42B 3/08; A42B 3/205; A41D 13/0568
See application file for complete search history.

(56) References Cited

U.S. PATENT DOCUMENTS

| | | | | | |
|---|---|---|---|---|---|
| 3,619,813 | A * | 11/1971 | Marchello | A42B 3/08 | 2/421 |
| 3,916,446 | A * | 11/1975 | Gooding | A42B 3/08 | 2/421 |
| 5,794,274 | A * | 8/1998 | Kraemer | A42B 3/205 | 2/9 |
| 6,481,024 | B1 * | 11/2002 | Grant | A42B 3/08 | 2/9 |
| 8,621,671 | B1 * | 1/2014 | Schiebl | A42B 3/205 | 2/421 |
| 9,307,800 | B2 * | 4/2016 | Andrews | A42B 3/00 | |
| 9,345,281 | B1 * | 5/2016 | Schiebl | A42B 3/205 | |
| 2022/0175074 | A1 * | 6/2022 | Rietdyk | A42B 3/145 | |
| 2023/0030261 | A1 * | 2/2023 | Reece | A42B 3/283 | |

* cited by examiner

*Primary Examiner* — Tajash D Patel
(74) *Attorney, Agent, or Firm* — Schwegman, Lundberg & Woessner, P.A.

(57) ABSTRACT

A chin strap assembly comprises a chin cup and a chin strap for mounting the chin cup to a helmet. The chin cup has a first side for contacting a user's chin and a second side opposite the first side, the second side including a first engaging structure. The chin strap has a second engaging structure for coupling the chin strap to the chin cup via the first engaging structure. The first engaging structure is offset on the chin cup and the second engaging structure is offset on the chin strap to provide various positioning options of the chin cup relative to the helmet.

20 Claims, 10 Drawing Sheets

ADJUSTABLE CHIN CUP

CROSS-REFERENCE TO RELATED APPLICATIONS

This patent application claims the benefit of priority to U.S. Patent Application Ser. No. 63/124,974 filed on Dec. 14, 2020, the contents of which are incorporated herein by reference as if expressly set forth.

BACKGROUND

Chin cups used with helmets for hockey or other sports have limited adjustability. Some chin cups are adjustable in being able to adapt to different face cages. Other chin cups may be can be adjusted by sliding them up and down along an axis on which they are mounted.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
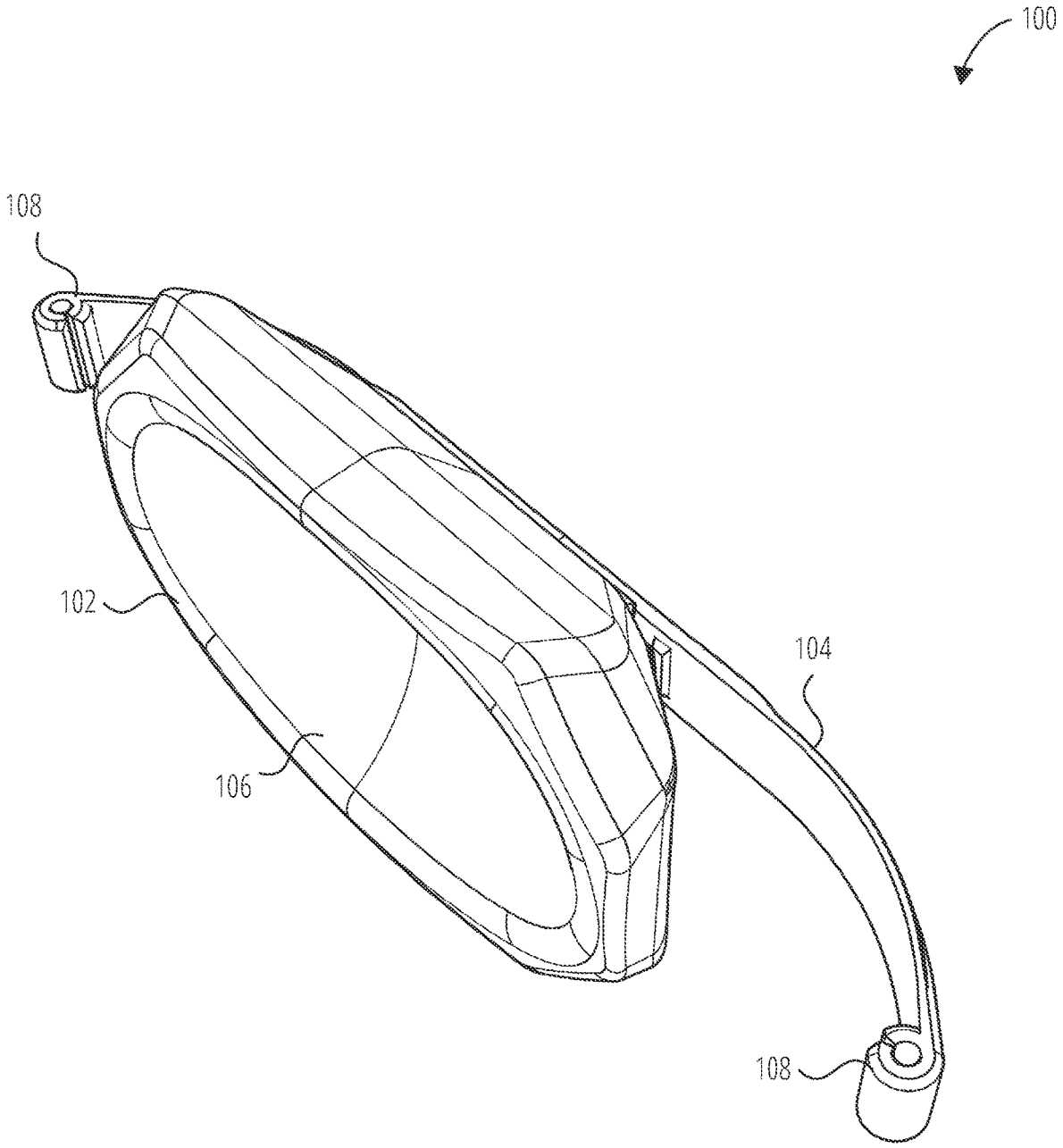
FIG. 1 is a perspective view of a chin cup assembly according to some examples.

Disclosed, in some examples, is a chin cup that has ergonomic adjustment options to bring the chin cup closer or farther away from a user's face relative to a helmet cage, position the chin cup higher or lower relative to the helmet cage or change the angle of the chin cup relative to the wearer's chin.

Commercially-available chin cups are available in different widths, depths, forms and materials to give users options for improving the fit of the helmet on the user's head. Existing chin cups do not allow the user to make further ergonomic adjustments other than choosing one based on initial fit, and the ability to move a chin cup between helmets is limited. Adjustability is typically limited to sliding the chin cup in one direction, typically up and down, such as a for a hockey helmet. How close the chin cup is to the user's face is determined by the depth of the chin cup as selected and which j-clip setting the user has chosen for the chin cup straps.

In some examples, provided is a chin strap assembly including a chin cup having a first side for contacting a user's chin and a second side opposite the first side, the second side including a first engaging structure, and a chin strap for mounting the chin cup to a helmet, the chin strap including a second engaging structure for coupling the chin strap to the chin cup via the first engaging structure, where the first engaging structure is offset on the chin cup or the second engaging structure is offset on the chin strap. Both the first engaging structure may be offset on the chin cup and the second engaging structure may be offset on the chin strap, and the offsets of the first and second engaging structures may be vertical offsets. An amount of the offset of the first engaging structure on the chin cup may be more than an amount of the offset of the second engaging structure on the chin strap.

The first engaging structure may include edges defining a receptacle in the chin cup and the second engaging structure may engage the edges of the receptacle in use. The first engaging structure and the second engaging structure may permit engagement therebetween at different distances of the chin cup from the chin strap. The second engaging structure may include a plurality of sets of teeth on opposite sides of the second engaging structure, such as on upper side and a lower side of the second engaging structure or on are a left side and a right side of the second engaging structure.

In some examples, a chin strap assembly includes chin cup having a first side for contacting a user's chin and a second side opposite the first side, the second side having a recess defined therein, and a chin strap for mounting the chin cup to a helmet, the chin strap including a plug for coupling the chin strap to the chin cup by inserting the plug into the recess, where the recess is offset on the chin cup or the plug is offset on the chin strap. Both the chin cup recess may be offset on the chin cup and the plug may be offset on the chin strap. An amount of the offset of the chin cup recess may be greater than an amount of the offset of the plug on the chin strap. The plug may also be angled on the chin strap.

The plug may include a plurality of sets of teeth for engaging edges of the recess, which may be located on an upper surface and a lower surface of the plug or on a left side and a right side of the plug.

In some examples, provided is a helmet including a shell and a chin strap assembly being coupleable to the shell. The chin strap assembly includes a chin cup having a first side for contacting a user's chin and a second side opposite the first side, the second side having a recess defined therein. The chin strap assembly also includes a chin strap for coupling the chin cup to the helmet, the chin strap including a plug for coupling the chin strap to the chin cup by inserting the plug into the recess, where the recess is offset on the chin cup or the plug is offset on the chin strap.

The plug may include a plurality of sets of teeth for engaging edges of the recess. The plurality of sets of teeth are either located on an upper surface and a lower surface of the plug or on a left side and a right side of the plug.

Other technical features may be readily apparent to one ski in the art from the following figures, descriptions, and claims.

FIG. 1 is a perspective view of a chin cup assembly 100 according to some examples. The chin cup assembly 100 includes a chin cup 102 and a chin cup strap 104. The chin cup 102, which includes a chin recess 106 for receiving a user's chin, is intended to help position and hold a helmet in a desired position on a user's head and in the case of hockey, to provide some attenuation of forces to the chin from impacts to the mask. The chin cup 102 may be of variable density or made of layers of different materials having different characteristics. For example, the chin cup 102 may have a stiffer material on an outwardly facing surface (against a metal cage, on the side of the chin cup strap 104) and a softer material or lower density version of the same material on the side that engages a user's chin, to provide comfort, conformance to the chin, and for absorbing energy from lower velocity impacts. A variety of chin cups 102 with different shapes and sizes, with different chin recess 106 depths, and with different material densities can also be provided to accommodate user preferences.

The chin cup strap 104 attaches to the outwardly facing surface of the chin cup 102 and extends sideways from the chin cup 102 to permit mounting of the chin cup assembly 100 to, for example, the cage of a helmet. A clip 108 is provided at each end for this purpose.

Figure 2:
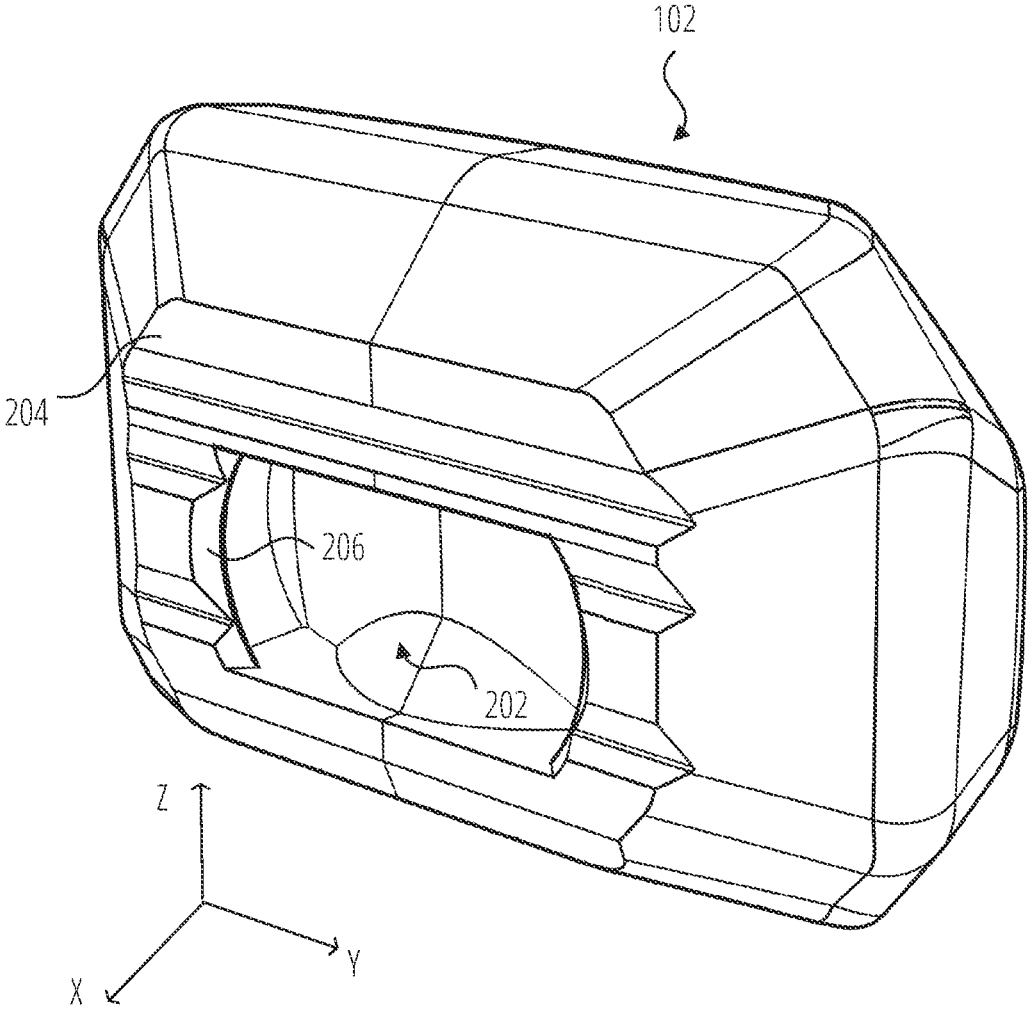
FIG. 2 is a perspective view of the rear of a chin cup according to some examples.

FIG. 2 is a perspective view of the rear (or outwardly facing surface) of the chin cup 102 according to some examples. As can be seen, the rear of the chin cup includes a receptacle 202 that receives a corresponding plug 302 (see FIG. 3) that is located on the chin cup strap 104. The receptacle 202 and plug 302 together form a mounting structure whereby the chin cup 102 and chin cup strap 104 are joined together to form the chin cup assembly 100. In the example shown in FIG. 2, the receptacle 202 is defined as a hole in a rear wall 204, with the edges 206 of the wall forming engagement structures with which corresponding structures on the chin cup strap 104 engage to hold the chin cup assembly 100 together. The edges 206 may be angled inward or outward to provide surfaces that cooperate with the plug 302 when the chin cup strap 104 is inserted into the receptacle 202 as discussed below with reference to FIG. 3.

While the chin cup 102 is generally symmetrical across its width and height, it should be noted that the receptacle 202 is not centrally placed along the height of the chin cup 102. That is, the receptacle 202 is vertically offset from the center of the chin cup 102 along the Z axis, so that if the chin cup 102 is rotated 180 degrees about the X axis, the receptacle 202 is respectively higher or lower on the rear wall 204 depending on which of the two horizontal positions the chin cup 102 occupies. This permits a degree of vertical adjustability as discussed in more detail below.

Figure 3:
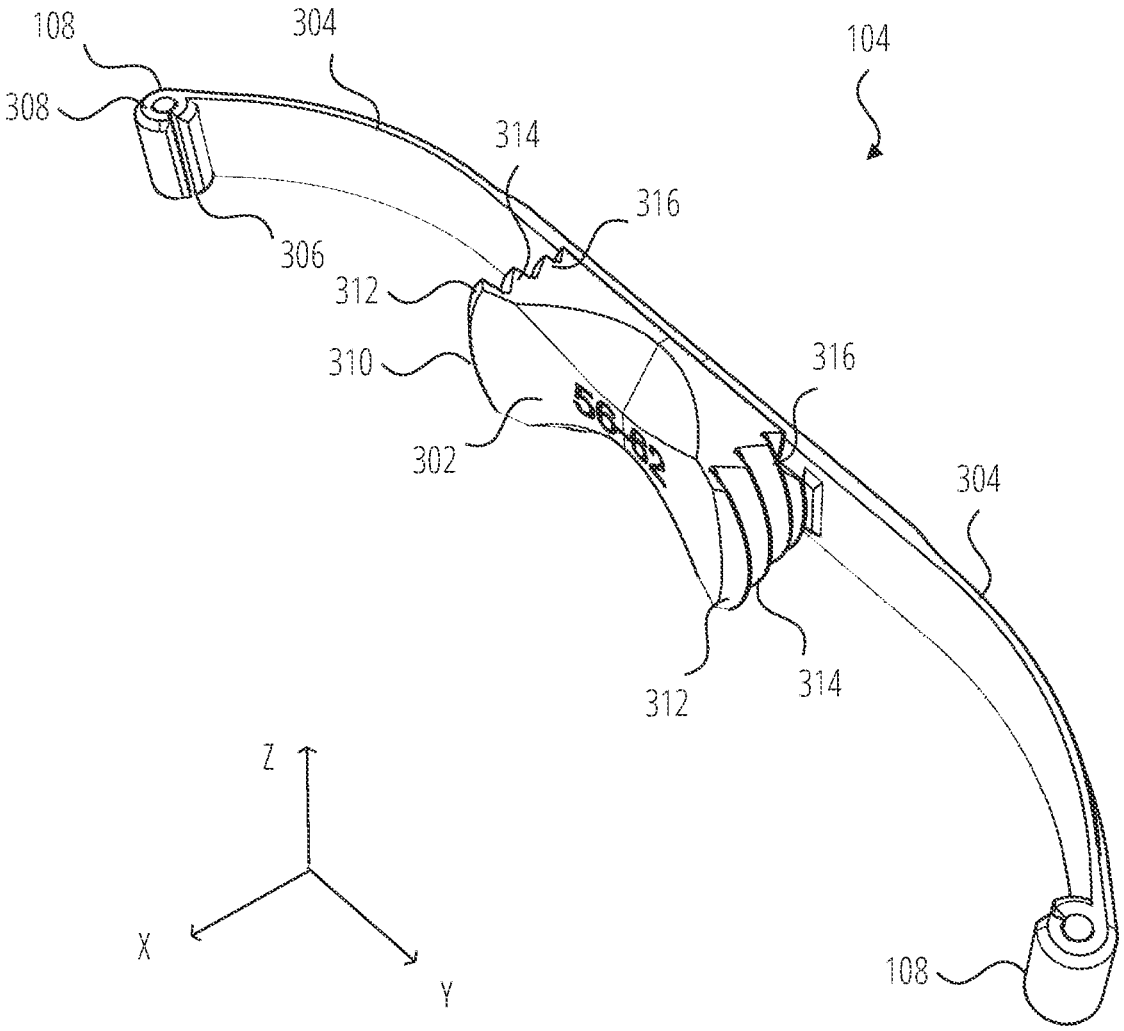
FIG. 3 is a perspective view of the rear of a chin cup strap according to some examples.

FIG. 3 is a perspective view of the rear of a chin cup strap 104 according to some examples. The chin cup strap 104 includes a central plug 302 from which two straps 304 extend. A clip 108 is provided at the end of each strap 304 for mounting the chin cup strap 104 to a helmet cage.

Each clip 108 is generally cylindrical in shape and includes a slot 306 through which a bar of a helmet cage can be pushed to attach the chin cup strap 104 to the helmet cage. The clip 108 includes an internal liner 308 that defines a bore in the clip 108 for receiving the bar of the helmet cage. Preferably, the exterior of the clip 108 is made of a relatively more rigid material to reduce the possibility that the chin cup strap 104 will easily pull off the helmet cage, while the liner 308 of the clip 108 is made of a relatively less rigid or softer material so that there is enough friction so that the chin cup strap 104 will stay in place on the helmet cage, but can also be slid up and down on the helmet cage by a user.

The plug 302 includes engagement structures 310 that serve to couple with the edges 206 of the receptacle 202 in the chin cup 102, thereby to hold the chin cup 102 and chin cup strap 104 together. In the illustrated example, the engagement structures 310 include three sets of teeth (teeth 312, teeth 314 and 316) on either side of the plug 302. The three sets of teeth have front surfaces (facing the chin cup 102) that are angled inward between 20 and 70 degrees relative to the plane of the strap 304 (the Y-Z plane in FIG. 3). This angled tooth shape facilitates pushing of the plug 302 of the chin cup strap 104 into the chin cup 102. Back surfaces of the three sets of teeth are (facing away from the chin cup 102) are between 0 and 20 degrees to the Y-Z plane. These more parallel rear tooth surfaces help retain the plug 302 in the receptacle 202 during use.

In one example, the sets of teeth (teeth 312, teeth 314 and 316) may be of a polymer material with a shore durometer between 50 and 105A/55D to provide sufficient give to enable a balance between a secure connection between the chin cup 102 and the chin cup strap 104 and enough give to adjust. Other materials or spring mechanisms may facilitate this same interaction.

The three sets of teeth permit the chin cup strap 104 to be inserted into the chin cup 102 to varying depths, permitting a degree of forward/backward adjustment of the position of the chin cup 102 relative to a user's chin, as shown in FIG. 5. Also, the teeth can be positioned on the upper or lower surface of the plug 302 instead of on the sides of the plug 302. In such a case, an additional degree of adjustability can be provided, in that a user can insert more or less teeth into engagement with the top and bottom edges of the receptacle 202, to tilt the chin cup 102 up or down relative to the strap 304. For example, by inserting two teeth on the bottom and one tooth on the top, to tilt the chin cup 102 upwards.

The width of each set of teeth decreases progressively from the first set of teeth 312 that engage the chin cup 102 to the final set of teeth 316 that engage the chin cup 102 when the plug 302 is pushed into the receptacle 202. This arrangement prevents the chin strap from getting progressively more difficult to push into the chin cup 102 if, for example the other sets of teeth remain engaged with the chin cup 102 as the plug 302 is pushed further into the chin cup 102.

Although not readily apparent in FIG. 3, the plug 302 is not centrally placed along the height of the strap 304. That is, the plug 302 is vertically offset from the center of the strap 304 along the Z axis, so that if the chin cup strap 104 is rotated 180 degrees about the X axis, the plug 302 is respectively higher or lower on the strap 304 depending on which of the two horizontal positions the chin cup strap 104 occupies. This permits an additional degree of vertical adjustability as discussed in more detail below. The amount of the vertical offset of the plug 302 on the strap 304 is different from the amount of the vertical offset of the receptacle 202 in the chin cup 102 to provide more adjustability options. In some examples, the vertical offset of the plug 302 on the strap 304 is about half of the vertical offset of the receptacle 202 in the chin cup 102.

In another example, the plug 302 is angled downward (or upward depending on the orientation of the chin cup strap 104) with respect to the strap 304, In such a case, the angle of the chin cup 102 relative to a user's chin will vary based on the orientation of the strap 304 on the helmet. It will of course also be appreciated that the number of teeth can be more or less than three sets, and the length of the plug 302 can differ, and that a variety of chin cup straps 104 with such variations can be provided to accommodate user preferences, for example as regards how far a chin cup 102 can be extended from a chin cup strap 104.

Figure 4:
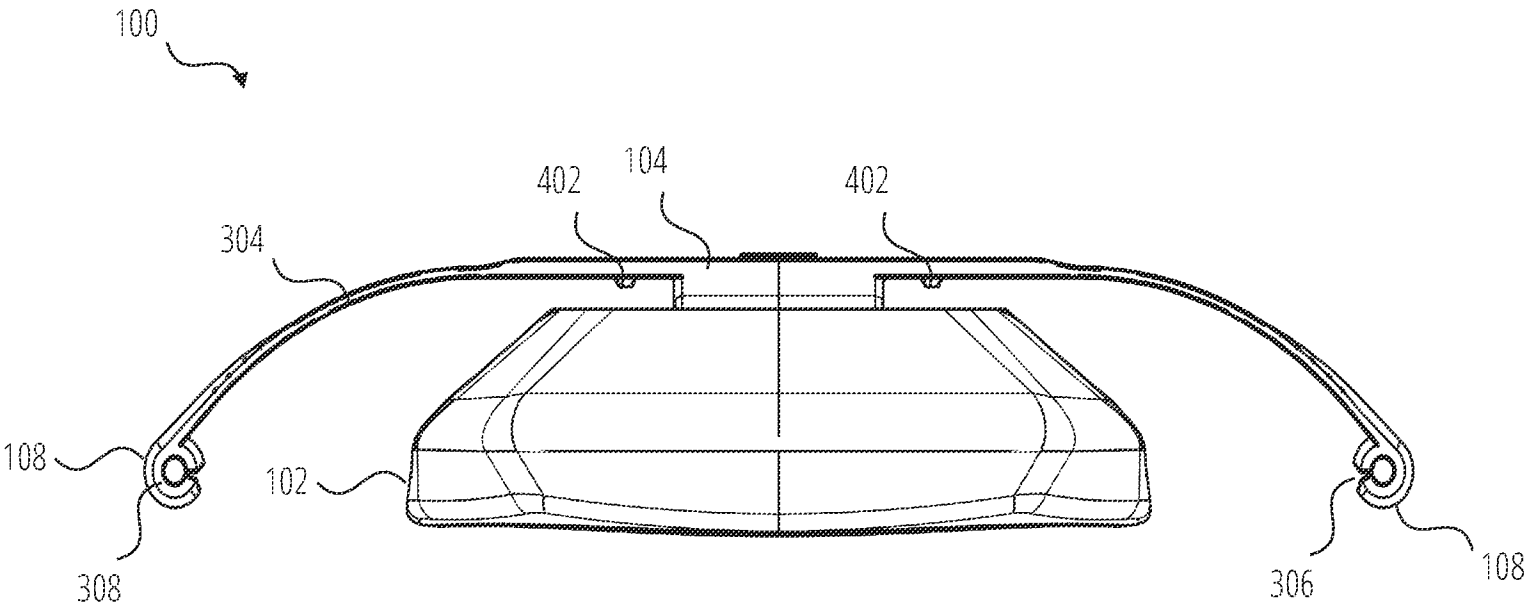
FIG. 4 is a plan view of the chin cup assembly 100 of FIG. 1.

FIG. 4 is a plan view of the chin cup assembly 100 of FIG. 1. As noted previously, the chin cup assembly 100 includes a chin cup strap 104 and a chin cup 102, the chin cup strap 104 having clips 108 to facilitate mounting of the chin cup assembly 100 to a face cage or other mounting structure of a helmet.

As shown in FIG. 4, the chin cup strap 104 may include protrusions 402 on the surface of the strap 304 facing the chin cup. The protrusions 402 are spaced apart along the strap 304 such that they will engage other bars of the face cage in use, to provide additional left/right stability of the helmet on the user's face. In this case, bars of the face cage are located between the chin cup strap 104 and the chin cup 102.

Figure 5A:
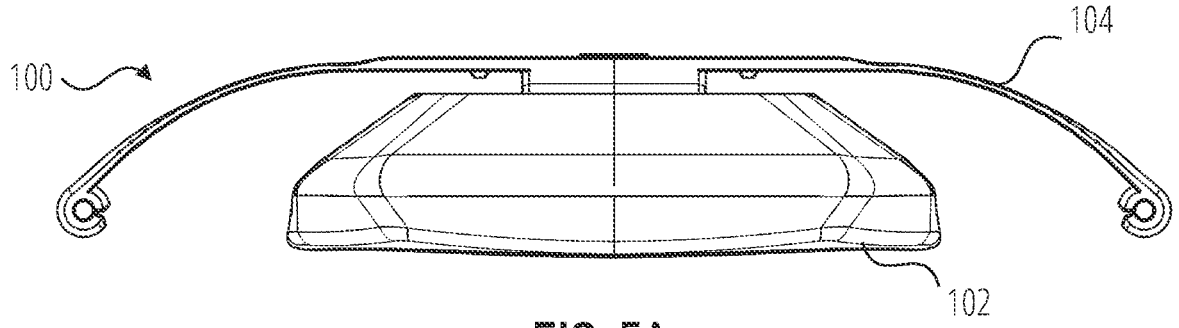
FIGS. 5A to 5C illustrate the adjustability of the chin cup assembly towards and away from the user's chin according to some examples.
Figure 5B:
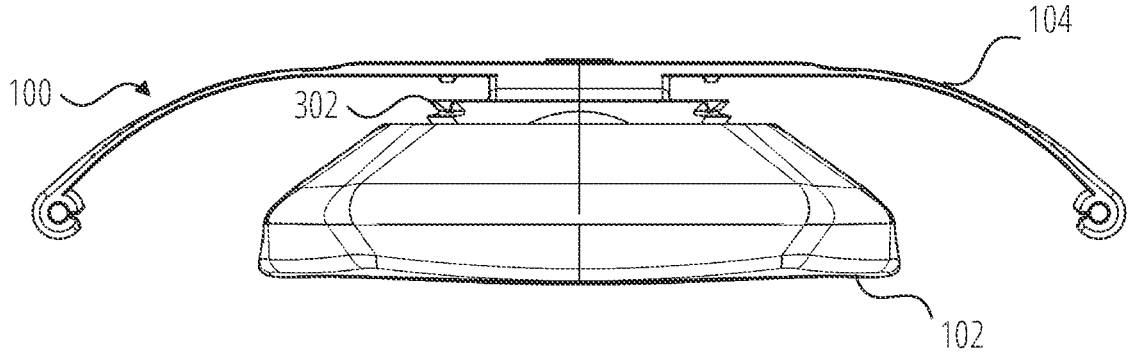
Figure 5C:
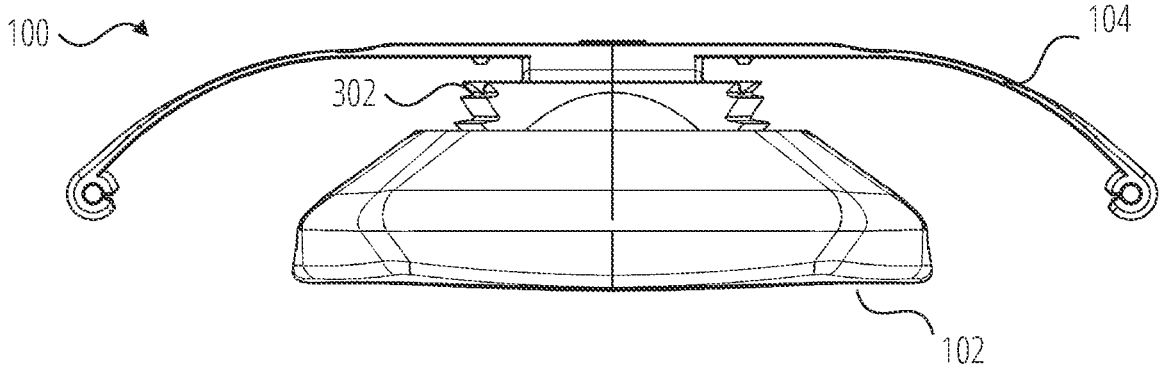

FIGS. 5A to 5C illustrate the adjustability of the chin cup assembly 100 towards and away from the user's chin according to some examples. In FIG. 5A, the plug 302 of the chin cup strap 104 has been pushed completely into the chin cup 102, although there is still some clearance between the chin cup 102 and chin cup strap 104 to permit relative movement between the chin cup 102 and chin cup strap 104 in use. FIG. 5A thus shows the chin cup 102 in the position in which it is furthest from the user's chin in use.

In FIG. 5B, the plug 302 of the chin cup strap 104 has been pushed half way into the chin cup 102. FIG. 5B thus shows the chin cup 102 in the middle of the three positions contemplated in the examples described herein.

In FIG. 5C, the plug 302 of the chin cup strap 104 has been pushed into the chin cup 102 to the shallowest position in which only the teeth 312 engage the chin cup 102. FIG. 5C thus shows the chin cup 102 in a position in which it is closest to the user's chin in use.

It will be appreciated that extending the chin cup 102 away from the chin cup strap 104 as shown in FIG. 5B and FIG. 5C also improves impact absorption, since the chin cup 102 can collapse onto the chin cup strap 104.

Figure 6A:
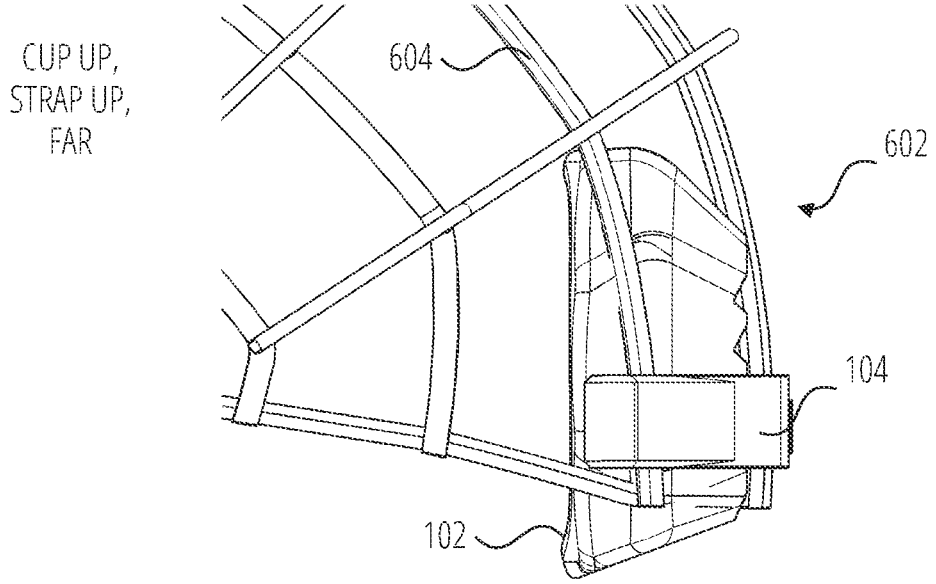
FIG. 6A and FIG. 6B illustrate the adjustability of the chin cup assembly based on rotation of the chin cup according to some examples.
Figure 6B:
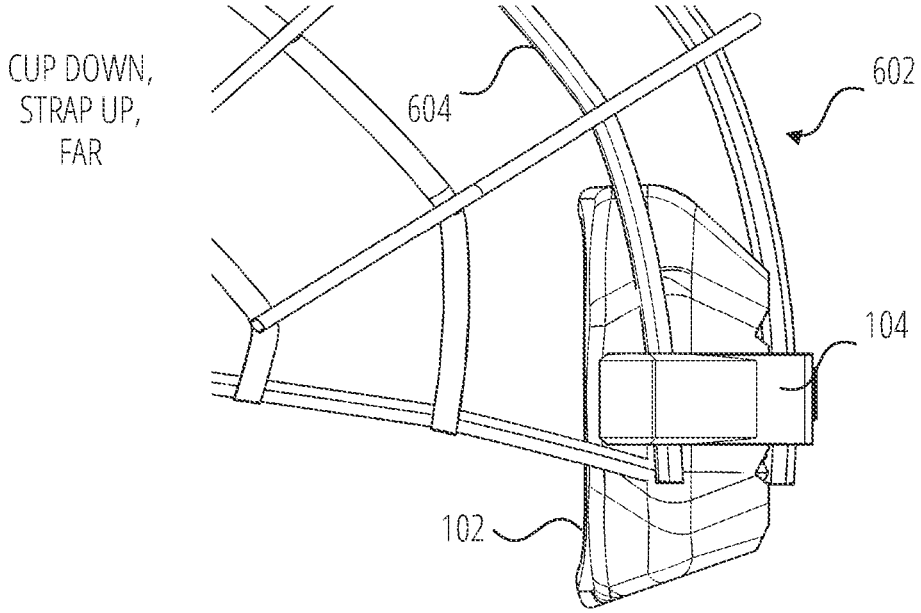

FIG. 6A and FIG. 6B illustrate the adjustability of the chin cup assembly 100 based on rotation of the chin cup 102 as discussed above with reference to FIG. 2, according to some examples. Shown in these figures are the chin cup 102, the chin cup strap 104 and a face cage 602. The face cage is coupled to a shell (not shown) of a helmet. The chin cup strap 104 is attached to bars 604 on either side of the face cage 602 via the clips 108.

In FIG. 6A, the strap is in an "up" position that positions the chin cup 102 slightly higher in the face cage 602 due to the offset of the plug 302; the chin cup 102 is in an "up" position in which the chin cup is positioned higher in the face cage 602 due to the offset of the receptacle 202, and the plug 302 of the chin cup strap 104 has been pushed all the way into the receptacle 202 so that the chin cup 102 is at its furthest position from a user's chin.

In FIG. 6B, the strap is in an "up" position that positions the chin cup 102 slightly higher in the face cage 602 due to the offset of the plug 302; the chin cup 102 is in a "down" position in which the chin cup is positioned lower in the face cage 602 due to the offset of the receptacle 202, and the plug 302 of the chin cup strap 104 has been pushed all the way into the receptacle 202 so that the chin cup 102 is at its furthest position from a user's chin.

Figure 7A:
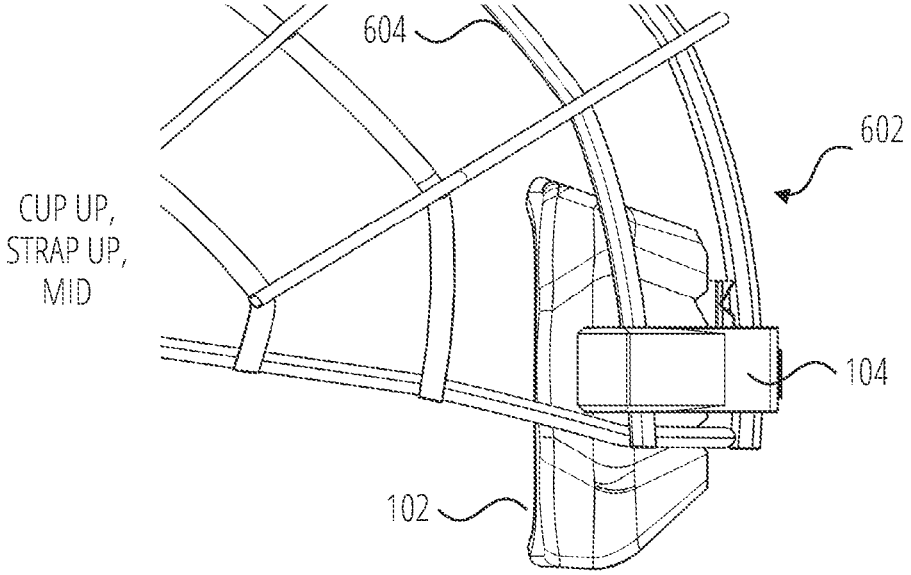
FIG. 7A and FIG. 7B also illustrate the adjustability of the chin cup assembly based on rotation of the chin cup according to some examples.
Figure 7B:
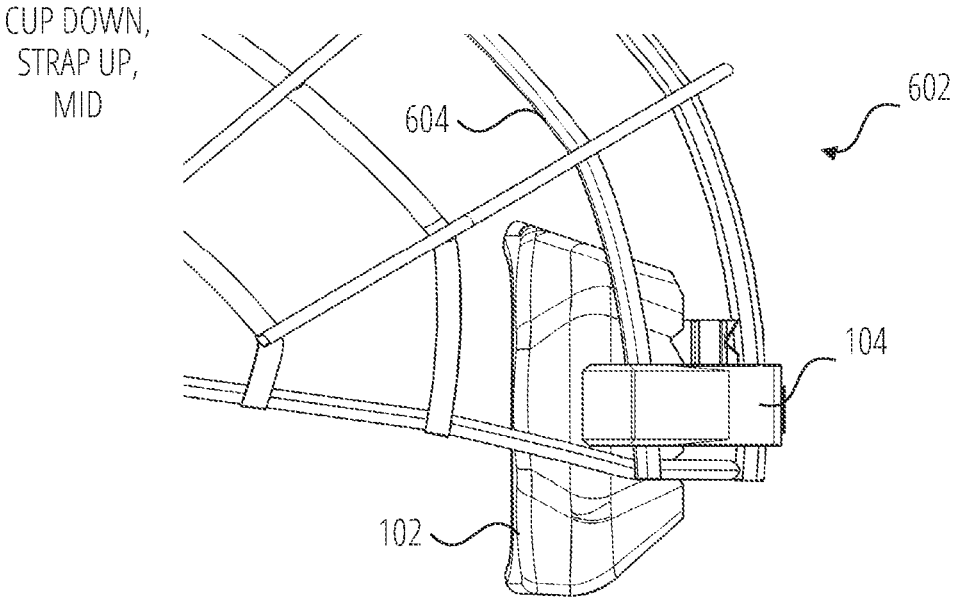

FIG. 7A and FIG. 7B illustrate the adjustability of the chin cup assembly 100 based on rotation of the chin cup 102 as discussed above with reference to FIG. 2, in a "middle" position of the plug 302 in the receptacle 202 of the chin cup 102, according to some examples.

In FIG. 7A, the strap is in an "up" position that positions the chin cup 102 slightly higher in the face cage 602 due to the offset of the plug 302; the chin cup 102 is in an "up" position in which the chin cup is positioned higher in the face cage 602 due to the offset of the receptacle 202, and the plug 302 of the chin cup strap 104 has been pushed half way into the receptacle 202 so that the chin cup 102 is in its middle position as regards distance from a user's chin.

In FIG. 7B, the strap is in an "up" position that positions the chin cup 102 slightly higher in the face cage 602 due to the offset of the plug 302; the chin cup 102 is in a "down" position in which the chin cup is positioned lower in the face cage 602 due to the offset of the receptacle 202, and the plug 302 of the chin cup strap 104 has been pushed half way into the receptacle 202 so that the chin cup 102 is in its middle position as regards distance from a user's chin.

Figure 8A:
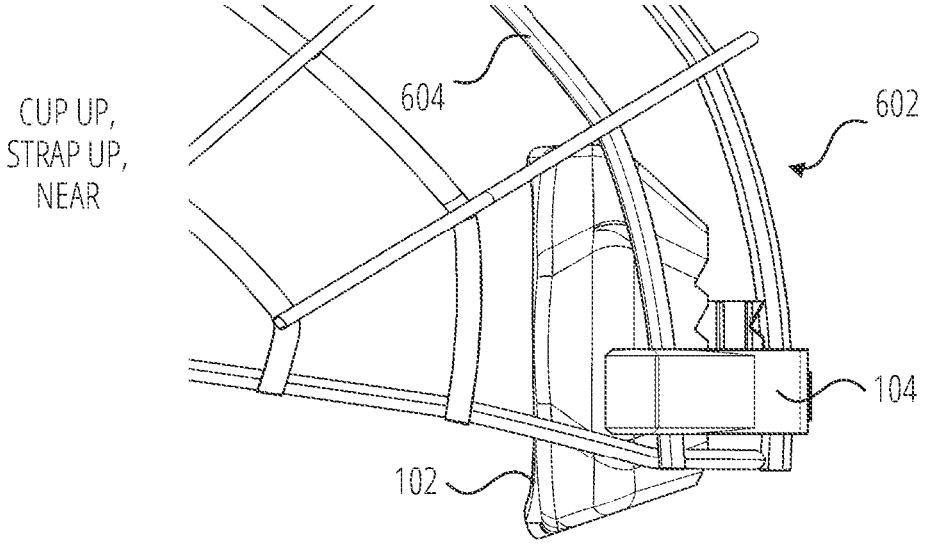
FIG. 8A and FIG. 8B also illustrate the adjustability of the chin cup assembly based on rotation of the chin cup according to some examples.
Figure 8B:
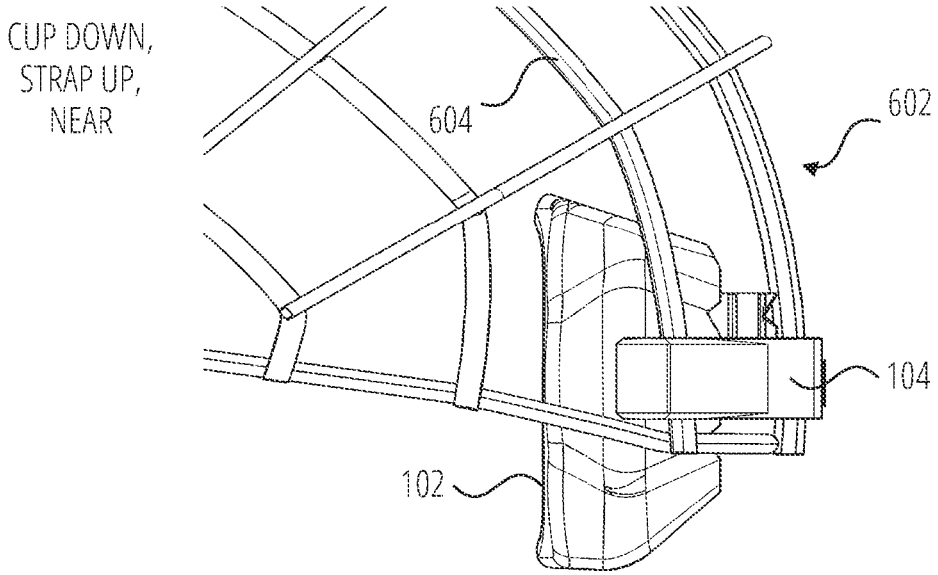

FIG. 8A and FIG. 8B illustrate the adjustability of the chin cup assembly 100 based on rotation of the chin cup 102 as discussed above with reference to FIG. 2, in a "near" position of the plug 302 in the receptacle 202 of the chin cup 102, according to some examples.

In FIG. 8A, the strap is in an "up" position that positions the chin cup 102 slightly higher in the face cage 602 due to the offset of the plug 302; the chin cup 102 is in an "up" position in which the chin cup is positioned higher in the face cage 602 due to the offset of the receptacle 202, and the plug 302 of the chin cup strap 104 has been pushed into the receptacle 202 so that the chin cup 102 is in its closest position to a user's chin, in which only the teeth 312 engage the edges 206 of the receptacle 202.

In FIG. 8A, the strap is in an "up" position that positions the chin cup 102 slightly higher in the face cage 602 due to the offset of the plug 302; the chin cup 102 is in a "down" position in which the chin cup is positioned lower in the face cage 602 due to the offset of the receptacle 202, and the plug 302 of the chin cup strap 104 has been pushed into the receptacle 202 so that the chin cup 102 is in its closest position to a user's chin, in which only the teeth 312 engage the edges 206 of the receptacle 202.

Figure 9A:
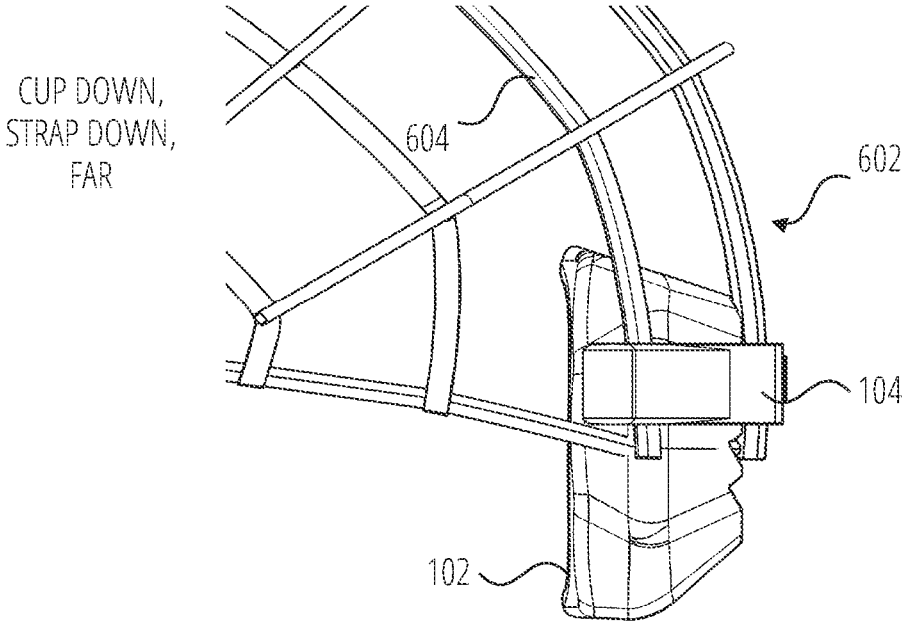
FIGS. 9A to 9C illustrate the adjustability of the chin cup assembly based on rotation of the chin cup strap according to some examples.
Figure 9B:
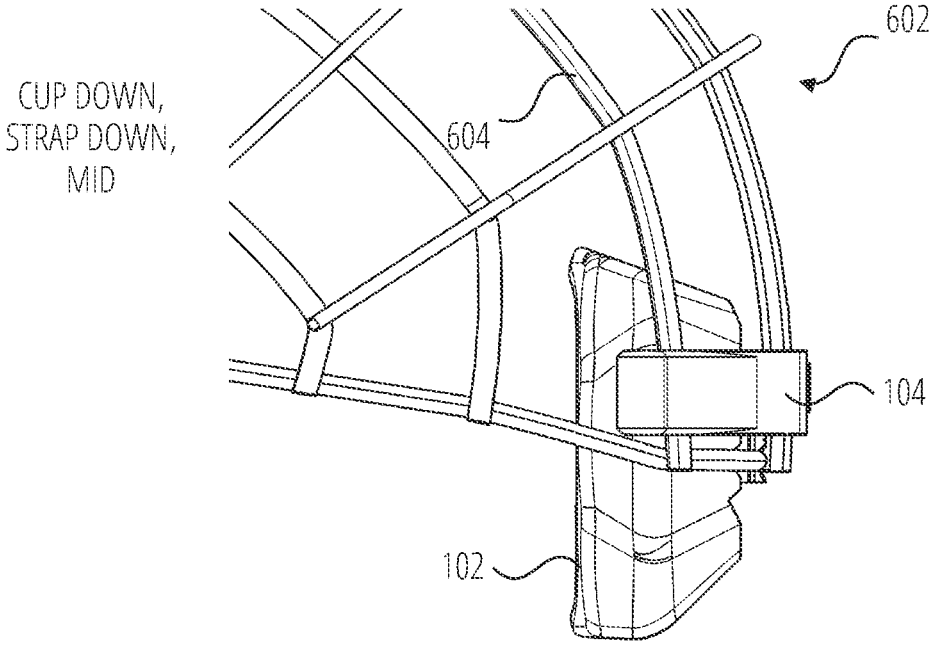
Figure 9C:
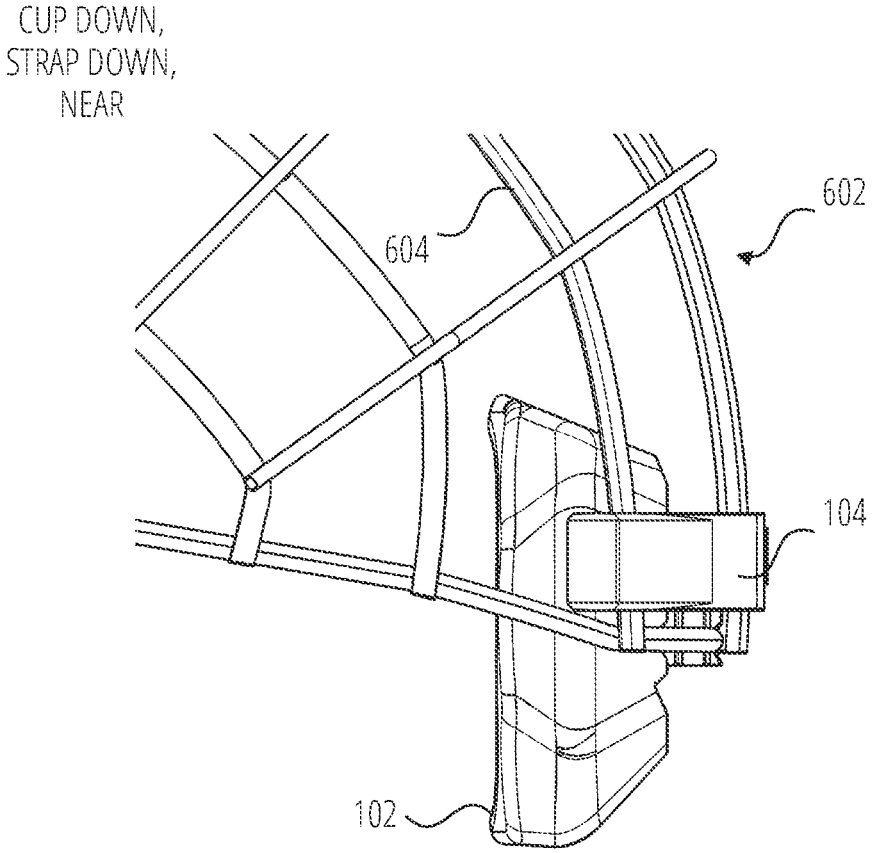

FIGS. 9A to 9C illustrate the adjustability of the chin cup assembly 100 based on rotation of the chin cup strap 104 as discussed above with reference to FIG. 3, according to some examples.

In FIG. 9A, the strap is in a "down" position that positions the chin cup 102 slightly lower in the face cage 602 due to the offset of the plug 302; the chin cup 102 is in a "down" position in which the chin cup is positioned lower in the face cage 602 due to the offset of the receptacle 202, and the plug 302 of the chin cup strap 104 has been pushed all the way into the receptacle 202 so that the chin cup 102 is at its furthest position from a user's chin.

In FIG. 9B, the strap is in a "down" position that positions the chin cup 102 slightly lower in the face cage 602 due to the offset of the plug 302; the chin cup 102 is in a "down" position in which the chin cup is positioned lower in the face cage 602 due to the offset of the receptacle 202, and the plug 302 of the chin cup strap 104 has been pushed half way into the receptacle 202 so that the chin cup 102 is in its middle position as regards distance from a user's chin.

In FIG. 9C, the strap is in a "down" position that positions the chin cup 102 slightly lower in the face cage 602 due to the offset of the plug 302; the chin cup 102 is in a "down" position in which the chin cup is positioned lower in the face cage 602 due to the offset of the receptacle 202, and the plug 302 of the chin cup strap 104 has been pushed into the receptacle 202 so that the chin cup 102 is in its closest position to a user's chin, in which only the teeth 312 engage the edges 206 of the receptacle 202.

FIGS. 9A to 9C, in which the chin cup 102 and the chin cup strap 104 are both in their "down" positions, represent the lowest positions of the chin cup 102 in the face cage 602, while FIG. 6A, FIG. 7A and FIG. 8A, in which the chin cup 102 and the chin cup strap 104 are both in their "up" position, represent the highest positions of the chin cup 102 in the face cage 602. FIG. 6B, FIG. 7B and FIG. 8B on the other hand, in which the chin cup strap 104 is in its "down" position while the chin cup 102 is in its "up" position represents the intermediate vertical positions of the chin cup 102 in the face cage 602.

As mentioned previously, the clips 108 of the chin cup strap 104 also permit the chin cup strap 104 to slide up and down on the bars 604, providing an additional vertical adjustment option.

Changes and modifications may be made to the disclosed examples without departing from the scope of the present disclosure. These and other changes or modifications are intended to be included within the scope of the present disclosure, as expressed for example in the following claims.

What is claimed is:

1. A chin strap assembly, comprising:

a chin cup having a first side for contacting a user's chin and a second side opposite the first side, the second side including a first engaging structure; and a chin strap for mounting the chin cup to a helmet, the chin strap including a second engaging structure for coupling the chin strap to the chin cup via the first engaging structure, wherein the first engaging structure is offset on the chin cup or the second engaging structure is offset on the chin strap.

2. The chin strap assembly of claim 1 wherein the first engaging structure is offset on the chin cup and the second engaging structure is offset on the chin strap.

3. The chin strap assembly of claim 2 wherein an amount of the offset of the first engaging structure on the chin cup is more than an amount of the offset of the second engaging structure on the chin strap.

4. The chin strap assembly of claim 1 wherein the offset of the first engaging structure is a vertical offset.

5. The chin strap assembly of claim 1 wherein the first engaging structure and the second engaging structure permit engagement therebetween at different distances of the chin cup from the chin strap.

6. The chin strap assembly of claim 1 wherein the first engaging structure comprises edges defining a receptacle in the chin cup and the second engaging structure engages the edges of the receptacle in use.

7. The chin strap assembly of claim 6 wherein the second engaging structure includes a plurality of sets of teeth.

8. The chin strap assembly of claim 7 wherein the second engaging structure includes a plurality of sets of teeth on opposite sides of the second engaging structure.

9. The chin strap assembly of claim 8 wherein the plurality of sets of teeth are located on an upper side and a lower side of the second engaging structure.

10. The chin strap assembly of claim 8 wherein the plurality of sets of teeth are located on a left side and a right side of the second engaging structure.

11. A chin strap assembly, comprising:

a chin cup having a first side for contacting a user's chin and a second side opposite the first side, the second side having a recess defined therein; and a chin strap for mounting the chin cup to a helmet, the chin strap including a plug for coupling the chin strap to the chin cup by inserting the plug into the recess, wherein the recess is offset on the chin cup or the plug is offset on the chin strap.

12. The chin strap assembly of claim 11 wherein both the chin cup recess is offset on the chin cup and the plug is offset on the chin strap.

13. The chin strap assembly of claim 12 wherein an amount of the offset of the chin cup recess is greater than an amount of the offset of the plug on the chin strap.

14. The chin strap assembly of claim 11 wherein the chin cup recess is offset on the chin cup and the plug is angled on the chin strap.

15. The chin strap assembly of claim 11 wherein the plug includes a plurality of sets of teeth for engaging edges of the recess.

16. The chin strap assembly of claim 15 wherein the plurality of sets of teeth are located on an upper surface and a lower surface of the plug.

17. The chin strap assembly of claim 15 wherein the plurality of sets of teeth are located on a left side and a right side of the plug.

18. A helmet, comprising:

a shell; and a chin strap assembly being coupleable to the shell, the chin strap assembly comprising a chin cup having a first side for contacting a user's chin and a second side opposite the first side, the second side having a recess defined therein; and a chin strap for coupling the chin cup to the shell, the chin strap including a plug for coupling the chin strap to the chin cup by inserting the plug into the recess, wherein the recess is offset on the chin cup or the plug is offset on the chin strap.

19. The helmet of claim 18 wherein the plug includes a plurality of sets of teeth for engaging edges of the recess.

20. The helmet of claim 19 wherein the plurality of sets of teeth are either located on an upper surface and a lower surface of the plug or on a left side and a right side of the plug.

* * * * *